US010820664B2

(12) United States Patent
Bishoff et al.

(10) Patent No.: US 10,820,664 B2
(45) Date of Patent: Nov. 3, 2020

(54) SHOE-FIT TESTING DEVICE

(71) Applicant: Target Brands, Inc., Minneapolis, MN (US)

(72) Inventors: Tyler Bishoff, Minneapolis, MN (US); Stacy Abel, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 245 days.

(21) Appl. No.: 16/116,643

(22) Filed: Aug. 29, 2018

(65) Prior Publication Data

US 2020/0069000 A1 Mar. 5, 2020

(51) Int. Cl.
*A43D 1/06* (2006.01)

(52) U.S. Cl.
CPC ..... *A43D 1/06* (2013.01)

(58) Field of Classification Search
CPC ..... A43D 1/06; A43D 1/027
USPC ..... 33/3 A, 3 B; 264/222, 219
See application file for complete search history.

(56) References Cited

U.S. PATENT DOCUMENTS 1,364,468 A * 1/1921 Wilson ..... A43D 3/025 12/124
1,647,639 A 11/1927 Larson
1,791,948 A * 2/1931 Bliss ..... A43D 1/06 33/3 A
1,873,532 A * 8/1932 Bliss ..... A43D 1/06 33/3 A
1,992,153 A * 2/1935 Bliss ..... A43D 1/06 33/3 A
2,043,649 A * 6/1936 Bliss ..... A43D 1/06 33/3 A
3,271,861 A * 9/1966 Fusco ..... A43D 1/027 33/3 B
3,335,428 A * 8/1967 Gajdos ..... A61F 2/66 623/55
6,168,741 B1 1/2001 Foldes
6,192,593 B1 * 2/2001 Borchers ..... A43D 1/02 324/716

(Continued)

FOREIGN PATENT DOCUMENTS

WO 2009129657 A1 10/2009

OTHER PUBLICATIONS

Roby, Erik—Mechanical Engineer, Foot—BSME Projects, Dated: May 30, 2018; 5 Pages.

(Continued)

*Primary Examiner* — Christopher W Fulton
(74) *Attorney, Agent, or Firm* — Merchant & Gould P.C.

(57) ABSTRACT

A shoe-fit testing device includes a pseudo skeletal structure and a pseudo soft tissue structure. The pseudo skeletal structure approximates the bone structure of a human foot and ankle, and the pseudo soft tissue structure encompasses the pseudo skeletal structure. The shoe-fit testing device is capable of transitioning between a compressed state and an uncompressed state. In the uncompressed state, the shoe-fit testing device has a joint girth that is measured at a first value. In the compressed state, the shoe fit testing device has a joint girth that is measured at a second value that is less than the first value. As such, the shoe-fit testing device approximates the flexibility and compressibility of the human foot without requiring a live model.

20 Claims, 9 Drawing Sheets

(56) References Cited

U.S. PATENT DOCUMENTS

| | | | | |
|---|---|---|---|---|
| 7,010,869 | B1 * | 3/2006 | Ellis | A43B 7/1415 36/10 |
| 8,763,261 | B1 * | 7/2014 | Kemist | G06Q 30/06 33/3 R |
| 9,460,557 | B1 | 10/2016 | Tran et al. | |
| 2007/0266581 | A1 * | 11/2007 | Long | A43D 1/06 33/555.4 |
| 2012/0316827 | A1 * | 12/2012 | Wilkinson | G01B 21/20 702/150 |
| 2018/0132568 | A1 * | 5/2018 | Kim | G01B 11/245 |

OTHER PUBLICATIONS

Henderson et al, UC-BL Shoe Insert—Casting and Fabrication; (Biomechanics Laboratory—University of California San Francisco Medical Center); Dated: 1999; 21 Pages.

Shorten et al., How We Test Shoes—See how much time, sweat, and science are involved in producing our Shoe Guide . . . a process we repeat four times a year; (How We Test Shoes/Runner's World); Dated Jul. 29, 2014; 10 Pages.

* cited by examiner

Photo above illustrates angle of girth measurements in relation to size stick

Illustrations above represent placement of girth measurements relative to the bone

SHOE-FIT TESTING DEVICE

BACKGROUND

Shoe vendors typically design their shoes in configurations and sizes to accommodate the most commonly found sizes and widths in a population. To verify to themselves and their retail partners that their shoe sizing is correct and fits well, shoe vendors will utilize live models to try on and wear the newly designed shoe. However, no two live models have exactly the same size and shape of foot nor do two live models have a foot that flexes at the same points and in the same manner. As such, assessing the fit of a shoe is never truly consistent.

SUMMARY

This summary is provided to introduce a selection of concepts in a simplified form that are further described below in the Detailed Description section. This summary is not intended to identify key features or essential feature of the claimed subject matter, nor is it intended as an aid in determining the scope of the claimed subject matter.

Aspects of the present disclosure are directed to a shoe-fit testing device that includes a pseudo skeletal structure and a pseudo soft tissue structure. The pseudo skeletal structure approximates the bone structure of a human foot and ankle, and the pseudo soft tissue structure encompasses the pseudo skeletal structure. The shoe-fit testing device is capable of transitioning between a compressed state and an uncompressed state. In the uncompressed state, the shoe-fit testing device has a joint girth that is measured at a first value. In the compressed state, the shoe fit testing device has a joint girth that is measured at a second value that is less than the first value.

In certain aspects the pseudo skeletal structure includes a number of elements that are less than a number of bones that exist in the human foot and ankle. For example, the pseudo skeletal structure includes a metatarsal component that approximates the five metatarsal bones of the human foot but with less than five pseudo bone elements. In certain aspects, only three pseudo bone elements are needed to approximate the five metatarsal bones of the human foot. In certain aspects, the pseudo skeletal structure comprises a plurality of separate and distinct elements each of which is separated from the other via the pseudo soft tissue structure. In certain aspects, the pseudo skeletal structure comprises a plurality of elements wherein at least a portion of the elements include a hollow center portion to reduce the weight of the pseudo skeletal structure. In certain aspects, the joint girth of the compressed shoe-fit testing device is at least five percent less than the joint girth of the uncompressed shoe-fit testing device. In certain aspects, an instep girth of the compressed shoe-fit testing device is also less than the instep girth of the uncompressed shoe-fit testing device.

Additional aspects of the present disclosure are directed to a shoe-fit testing device that includes a pseudo skeletal structure and a pseudo soft tissue structure wherein the pseudo skeletal structure approximates the bone structure of a human foot and ankle with an ankle joint component, a pseudo metatarsal component and a plurality of removable flex inserts; the pseudo soft tissue structure encompasses the pseudo skeletal structure.

In certain aspects, the pseudo skeletal structure additionally includes a toe plate that approximates the small toes of the human foot as well as a first hallux stabilizer which approximates the large toe of the human foot. In certain aspects, the ankle joint component includes an upper portion that defines an elongate channel and a lower portion that defines a projection received within the elongate channel; the upper and lower portion are separated by the pseudo soft tissue structure. In certain aspects, the plurality of removable flex inserts include at least one open flex channel having a portion that is centered beneath the ankle joint component. In certain aspects, the various elements of the pseudo skeletal structure are fabricated from an acrylonitrile butadiene styrene (ABS) plastic while the pseudo soft tissue structure is fabricated from a urethane elastomer.

Another aspect of the present disclosure is directed to a method of fabricating a shoe-fit testing device. The method includes: (a) fabricating a plurality of structural components that approximate a skeletal structure of a human foot and ankle; (b) fabricating a mold that approximates the outer skin surface of the soft tissues of the human foot and ankle; (c) placing the plurality of structural components within the mold such that each of the plurality of structural components is maintained distinctly separate from all other structural components, the placing of the plurality of structural components including suspending at least a portion of the plurality of structural components within the mold; (d) injecting the mold with a molding material, the molding material encompassing the plurality of structural components and forming a shoe-fit testing device; and (e) removing the shoe-fit testing device from the mold.

Another aspect of the present disclosure is directed to a method of manufacturing a shoe. The method includes: (a) manufacturing a shoe-fit testing device according to the methods described herein; (b) defining the elements of a shoe, including a sole and an upper; (c) fitting the sole and the upper to the shoe-fit testing device or a last based on the shoe fit testing device; and (d) assembling the fitted elements as a shoe.

The details of one or more aspects are set forth in the accompanying drawings and description below. Other features and advantages will be apparent from a reading of the following detailed description and a review of the associated drawings. It is to be understood that the following detailed description is explanatory only and is not restrictive of the claims.

BRIEF DESCRIPTION OF THE DRAWINGS

The accompanying drawings, which are incorporated in and constitute a part of this disclosure, illustrate various aspects. In the drawings.

DETAILED DESCRIPTION

Figure 1A:
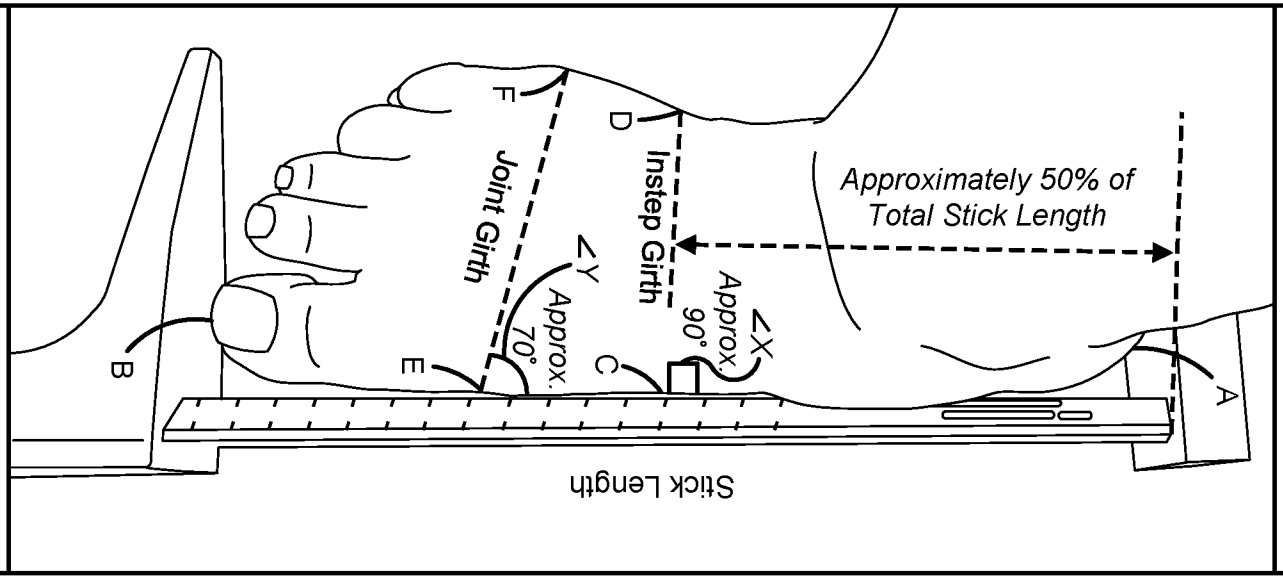
FIG. 1A illustrates example foot measurements of a live model taken in consideration of a shoe-fit testing device of the present disclosure.

The following detailed description refers to the accompanying drawings. Wherever possible, the same references numbers are used in the drawings and the following description refers to the same or similar elements. While examples may be described, modifications, adaptations or other implementations are possible. For example, substitutions, additions or modifications may be made to the elements illustrated in the drawings, and the method described herein may be modified by substituting, reordering or adding stages to the disclosed methods. Accordingly, the following detailed description is not limiting, but instead, the proper scope is defined by the appended claims. The following detailed description is, therefore, not to be taken in a limiting sense.

As briefly described above, aspects of the disclosure are directed to a shoe-fit testing device that can be used to replicate the foot and ankle of a live model, including the flexure of the foot and ankle of the live model, when testing the sizing of a shoe. The shoe-fit testing device of the present disclosure utilizes a pseudo skeletal structure to approximate the bone structure of a human foot and ankle through use of a minimal number of lightweight components, e.g. pseudo bones. More specifically, the number of components, or pseudo bones, is significantly less than the number of actual bones in the human foot and ankle. The shoe-fit testing device of the present disclosure also utilizes a pseudo soft tissue structure to support and encompass the pseudo skeletal structural. The resulting combination of the pseudo skeletal structure and the pseudo soft tissue structure is a shoe-fit testing device that presents a twistable ankle joint as well as a joint girth and/or an instep girth that can compress and uncompress as human foot would when being inserted within a shoe. As such, it can be measured and/or observed as to whether the shoe-fit testing device, which is sized to a specific shoe size, fits suitably within a shoe that should correspond to that specific size. Measurements to be taken or observed when using the shoe-fit testing device include foot length, in-step girth and joint girth.

Figure 1B:
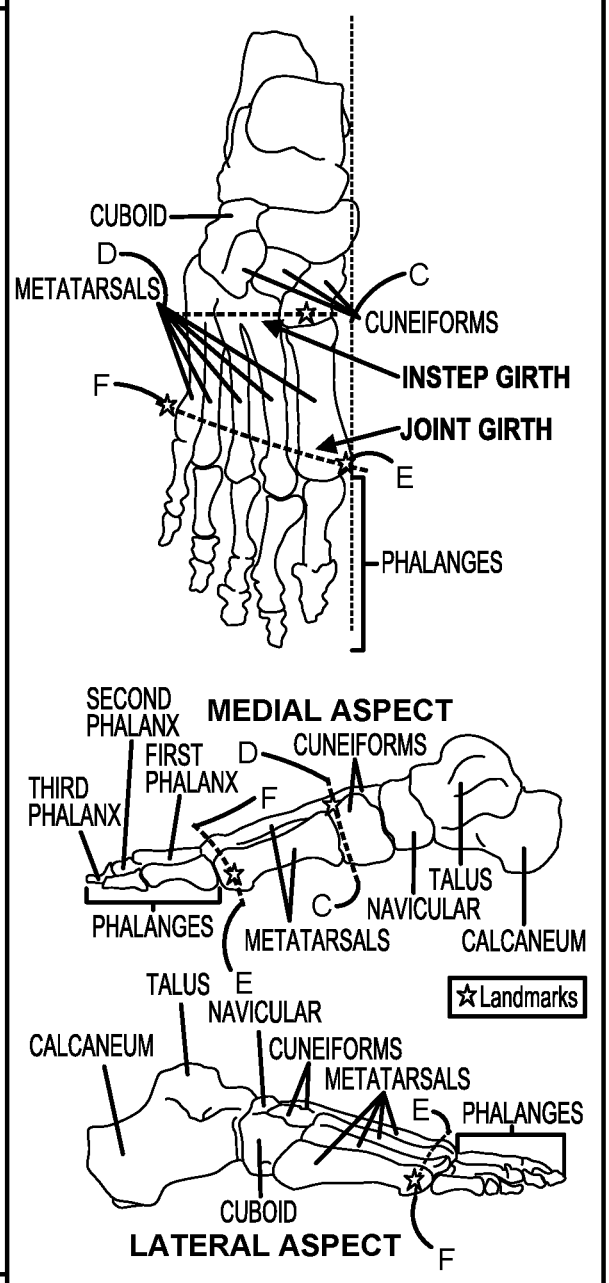
FIG. 1B illustrates placement of the foot measurements of FIG. 1A relative to the bones of the foot.

FIGS. 1A and 1B illustrate various foot measurements taken into consideration when testing the fit of a shoe. A first foot measurement includes a length (L) of the foot; FIG. 1A depicts a size stick 10 usable to measure the length of a live model's foot between the heel (A) and the toe (B). A second foot measurement includes an instep girth which, as illustrated in FIG. 1A, is measured along a line C-D that is perpendicular (∠X=90 degrees) to approximately the midpoint of the length (L) of the foot and is across a width of the foot. A third foot measurement includes a joint girth which, as illustrated in FIG. 1A is measured along a line E-F across a width of the foot at approximately the joint where the phalanges are joined to the metatarsals of the foot. Line E-F is at an angle (∠Y) of approximately 70 degrees relative to the line A-B.

As noted earlier, live models may have a foot of the same length but their instep girth and joint girth measurements can vary. Further, as the foot is squeezed, such as when being inserted into a shoe, the ability of the foot to flex in response to the squeezing action also varies. For example, the joint girth and/or the instep girth may narrow more or less depending on the structure of the live model's foot.

To help overcome this variation in foot geometry and flexibility associated with live models, the shoe-fit testing device of the present disclosure takes into consideration the variations in measurements of length, instep girth and joint girth (in both uncompressed and compressed positions) of hundreds of live models having a specific foot length to produce design parameters that reflect a composite of the measurements. For example, based on the data obtained from the live models, it was determined that an optimal shoe-fit testing device for a size 6 (US) shoe has a length of 229 mm, a joint girth of 226 mm, an instep girth of 221 mm, and a squeezed/compressed joint girth of 212 mm (e.g. a reduction in joint girth and/or instep girth of approximately 6%).

Figure 2A:
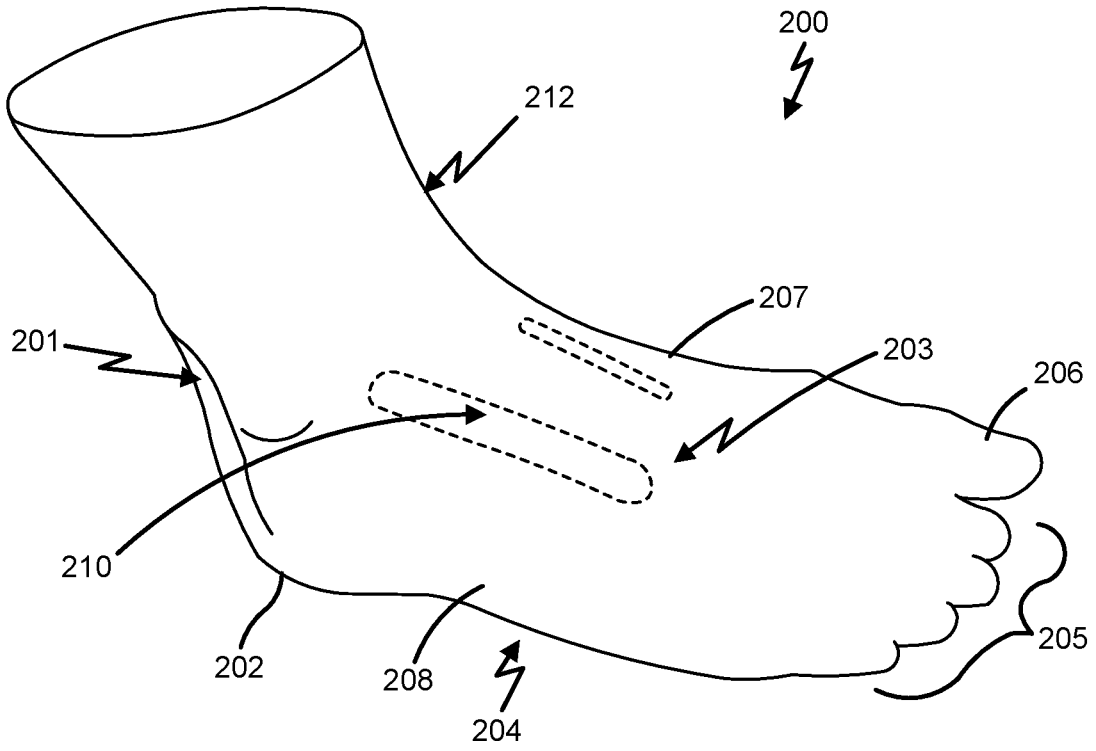
FIG. 2A is a top perspective view of an example embodiment of the shoe-fit testing device with a translucent soft tissue structure enabling the viewing of some components of a pseudo skeletal structure.
Figure 2B:
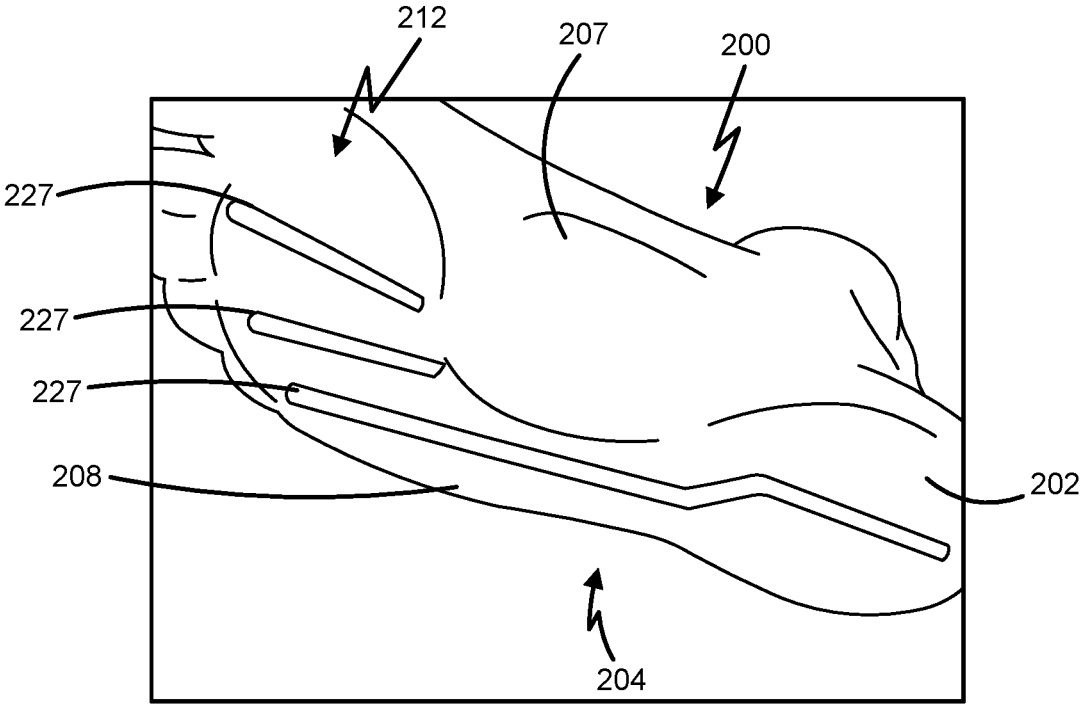
FIG. 2B is a bottom perspective view of the example embodiment of the shoe-fit testing device of FIG. 2A.
Figure 3:
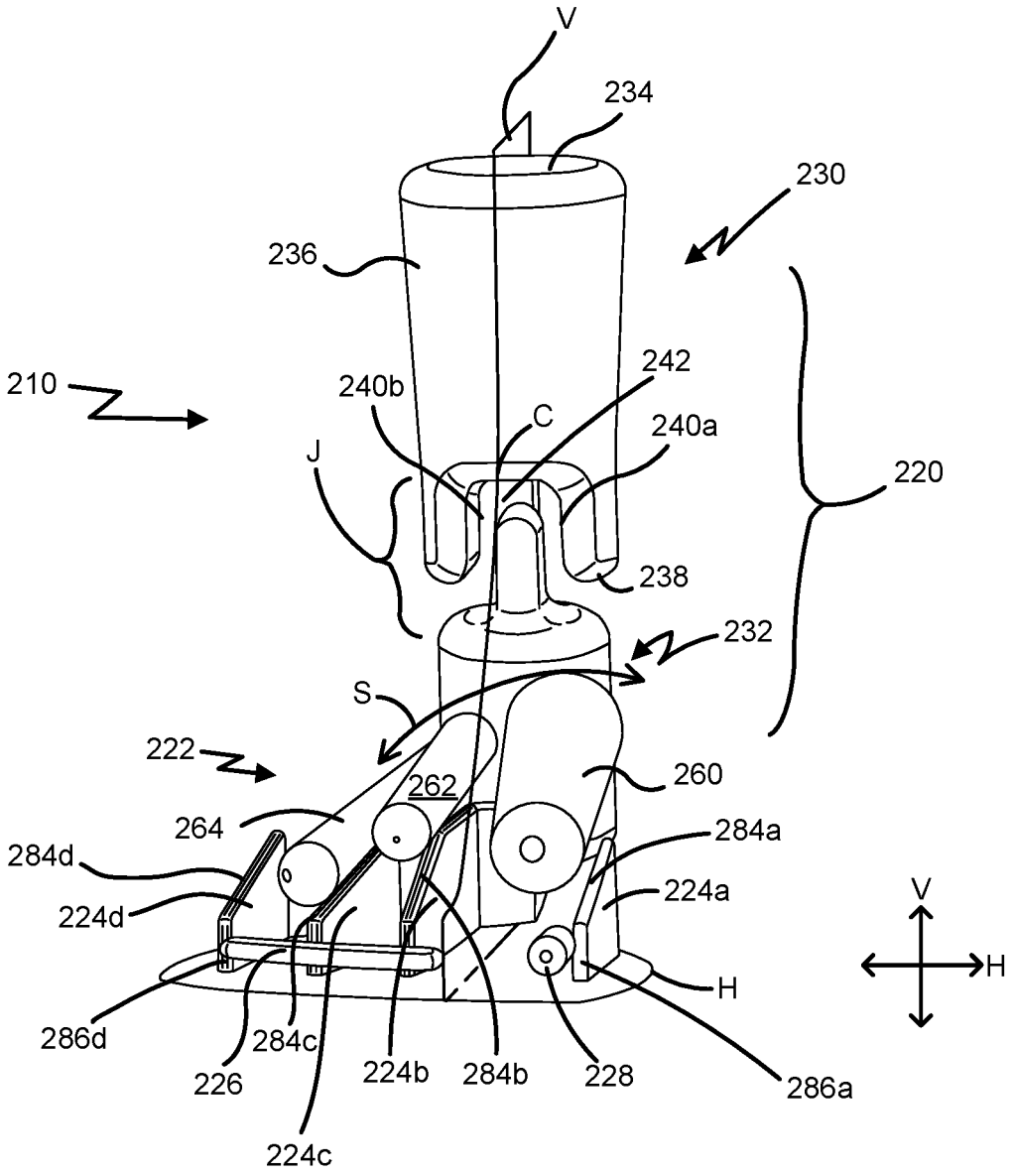
FIG. 3 is a forward perspective view of an example of the pseudo skeletal structure of the shoe-fit testing device.
Figure 4:
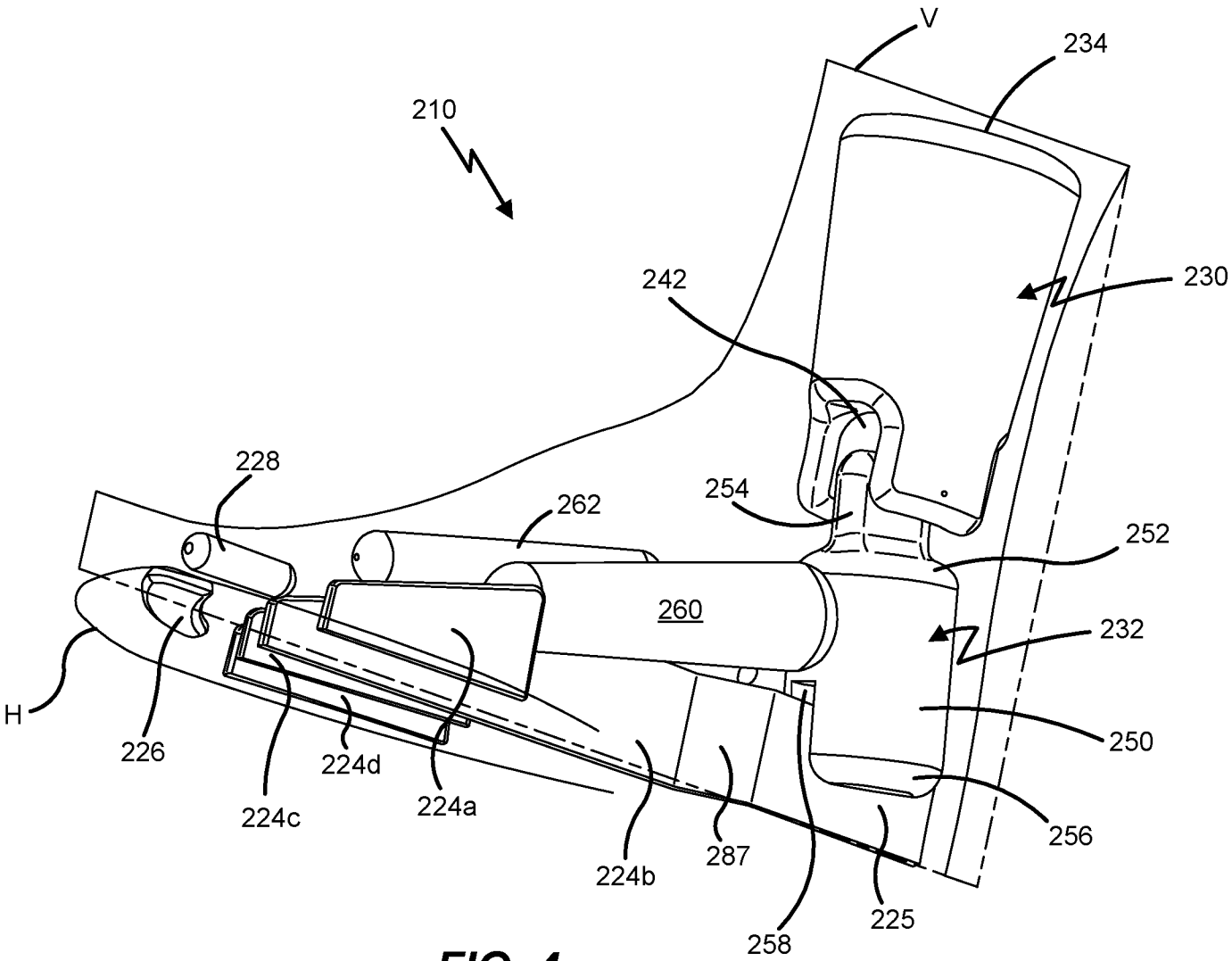
FIG. 4 is an in-step side perspective view of the pseudo skeletal structure of FIG. 3.
Figure 5:
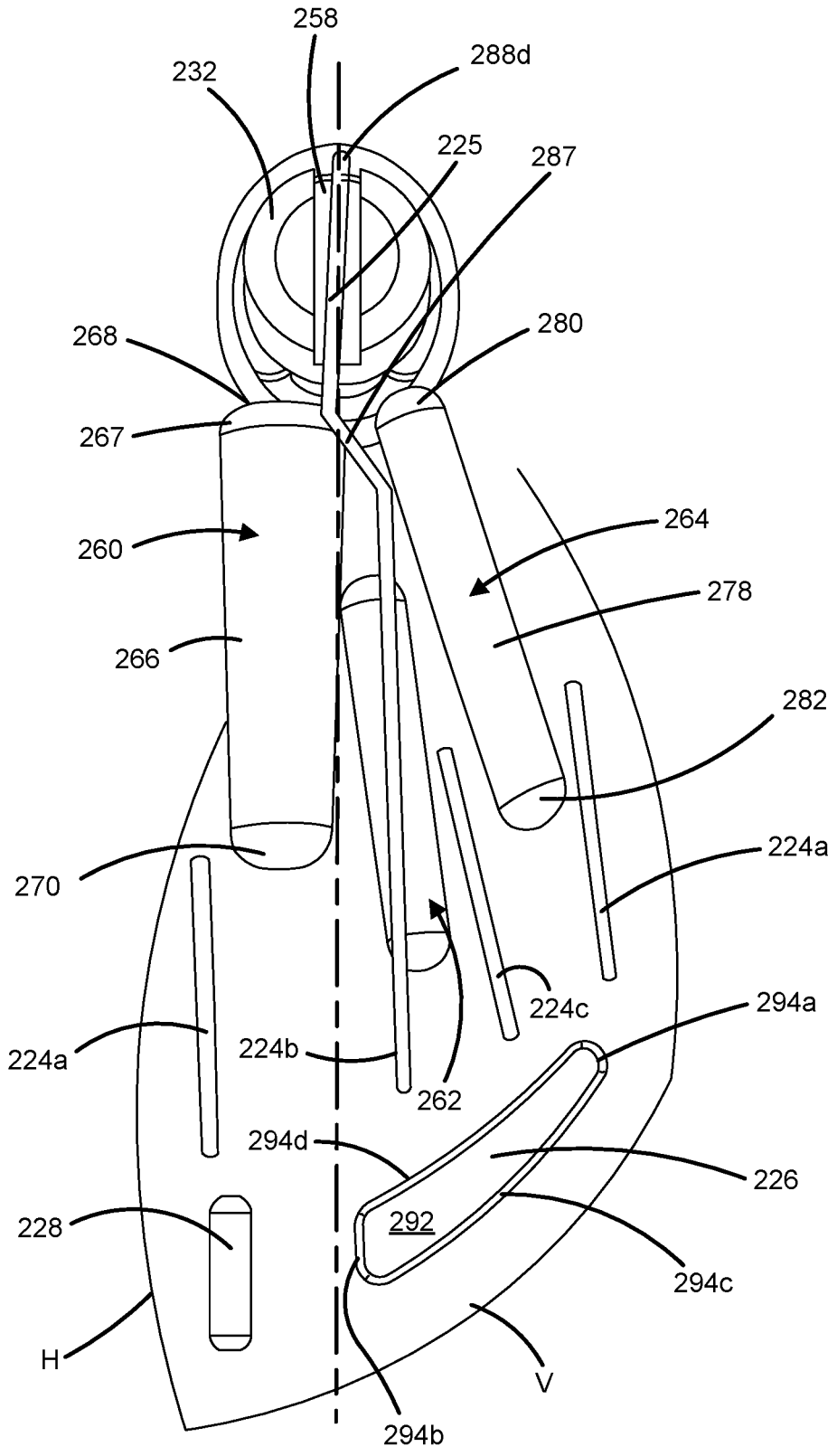
FIG. 5 is a bottom plan view of the pseudo skeletal structure of FIG. 3.
Figure 6:
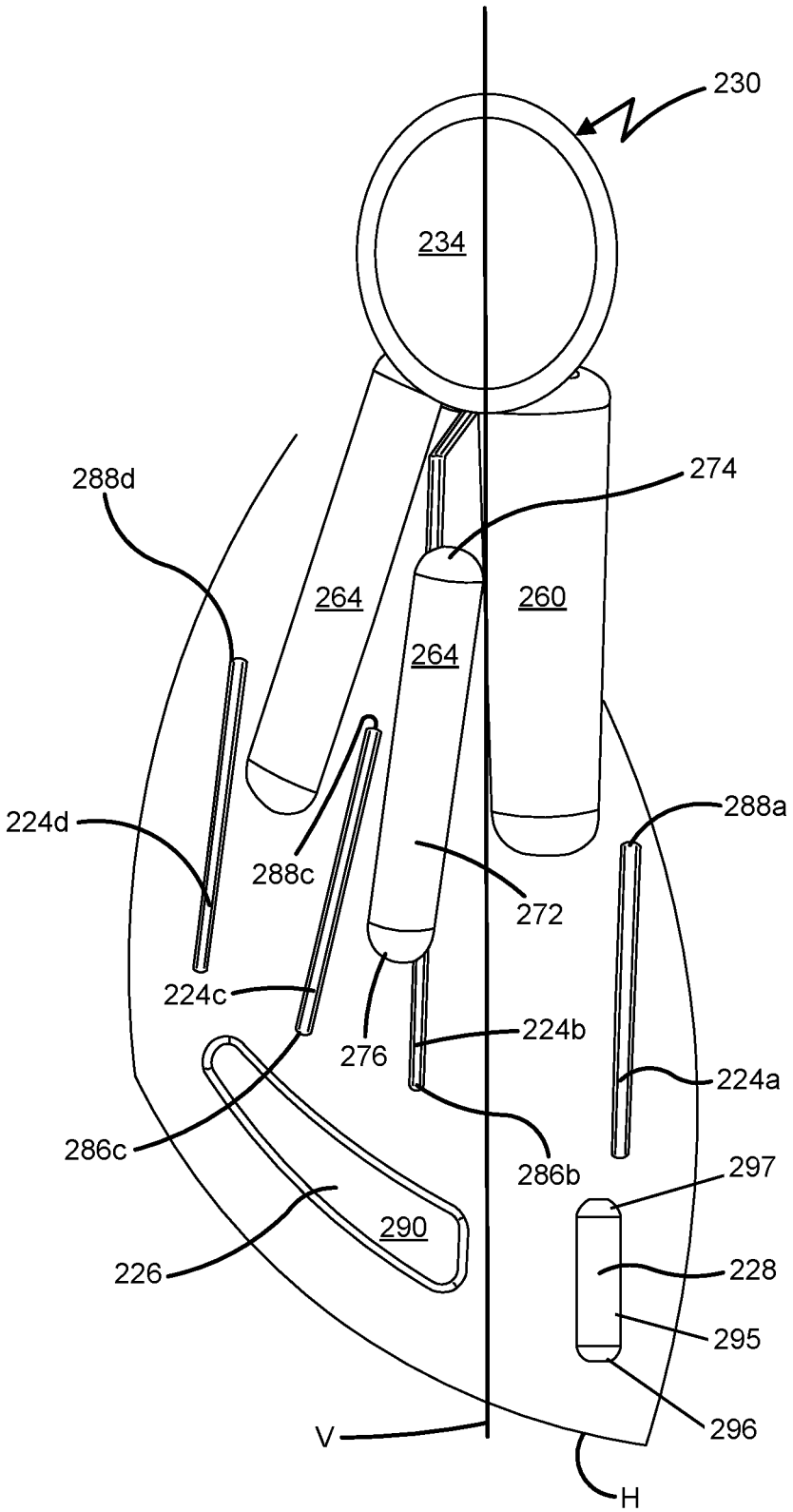
FIG. 6 is a top plan view of the pseudo skeletal structure of FIG. 3.

An example embodiment of a shoe-fit testing device 200 is illustrated in FIGS. 2A-2B. The shoe-fit testing device 200 generally comprises a pseudo skeletal structure 210 and a pseudo soft tissue structure 212.

In certain examples, the shoe-fit testing device 200 is capable of transitioning between a compressed position, such as when squeezed to be inserted into a shoe, and a uncompressed position, such as when fully inserted into the shoe or resting outside the shoe. In certain examples, the instep girth and/or the joint girth of shoe-fit testing device 200 is compressible, relative to its uncompressed state, by at least 2%. In certain examples, the instep girth and/or the joint girth of shoe-fit testing device 200 is compressible, relative to its uncompressed state, by at least 5%. In certain examples, the instep girth and/or the joint girth of shoe-fit testing device 200 is compressible, relative to its uncompressed state, by at least 7%.

The pseudo skeletal structure 210 of the shoe-fit testing device 200 includes an ankle joint component 220, a pseudo metatarsal component 222, a plurality of removable flex inserts 224 including removable flex inserts 224*a*-224*d*, a toe plate 226 and a first hallux stabilizer 228. In certain examples, the elements of the pseudo skeletal structure 210 are fabricated from a acrylonitrile butadiene styrene (ABS), which comprises a thermoplastic and amorphous polymer; however, other suitable plastics and/or polymers can also be used. Further, in certain examples, all but the plurality of removable flex inserts 224 and toe plate 226, are fabricated as non-solid components having solid exteriors and hollow interiors/center portions to reduce the overall weight of the shoe-fit testing device 200. Notably, the pseudo skeletal structure 210 does not replicate all bones of the foot, ankle and leg but, rather, approximates the skeletal structure with a minimized number of elements to reduce the cost in fabricating, as well as reduce the weight added to, the shoe-fit testing device 200 by the pseudo skeletal structure elements.

Referring to FIGS. 3-6, the ankle joint component 220 of the pseudo skeletal structure 210 is defined by an upper portion 230 and a lower portion 232. The upper portion 230 includes a substantially planar top surface 234 have edges that round downward to meet a cylindrical side wall 236. In certain examples, the circumference defined by the cylindrical side wall 236 narrows as it extends from the top surface 234 to a rounded bottom edge 238 in the joint area (J) just as a human leg narrows towards the ankle. Further, first and second interior side walls 240*a*, 240*b* of the upper portion 230 extend upward from the bottom edge 238 to join at a central location (C) and define a horizontally elongate channel 242 through the upper portion 230. Note that a reference vertical plane (V) and a reference horizontal plane (H), which correspond in shape to the pseudo soft tissue structure 212, are included in the drawings.

The lower portion 232 of the ankle joint component 220 includes a cylindrical body 250 having a top surface 252 that extends into a central projection 254 having a substantially rectangular cross-section. The central projection 254 generally aligns with the elongate channel 242 of the upper portion 230 of the ankle joint component 220 and is received, at least partially, within the elongate channel 242. Note that there is no direct interface between the central projection 254 and the elongate channel 242. Rather, the interstices between the central projection 254 and the elongate channel 242 are filled by the pseudo soft tissue structure 212, which is described in further detail herein. A bottom surface 256 of the cylindrical body 250 recedes into a channel 258 that extends horizontally through the cylindrical body 250; the channel 258 is generally vertically aligned with the projection 254.

The pseudo metatarsal component 222 is illustrated as including three distinct pseudo bone elements 260, 262 and 264 that approximate the shape established by the five metatarsal bones of the human foot as well as the shape established by the cuboid, navicular and cuneiform bones of the human foot. While the three pseudo bone elements depicted are believed to be the optimal combination of elements, fewer or a greater number of elements can be used in approximating the metatarsal, cuboid, navicular and cuneiform bones. Pseudo bone element 260 is the largest in circumference of the three elements having a cylindrical body portion 266 that narrows in circumference as it extends, via a rounded edge 267, from its planar rear surface 268 to a dome-shaped nose 270. Pseudo bone element 262 is the smallest in circumference and length of the three elements and includes a cylindrical body 272 capped by a rearward dome-shaped nose 274 and a forward dome-shaped nose 276. Pseudo bone element 264 has a circumference intermediate the circumference of pseudo bone elements 260 and 262 and has a length substantially equivalent to that of pseudo bone element 260. Pseudo bone element 264 includes a cylindrical body 278 capped by a rearward dome-shaped nose 280 and a forward dome-shaped nose 282.

Each of pseudo bone elements 260, 262, 264 are independent elements that are unattached to any other element of the pseudo skeletal structure 210. Rather, each of pseudo bone elements 260, 262, and 264 are suspended within the pseudo soft tissue structure 212 of the shoe-fit-testing device 200. Specifically, pseudo bone elements 260, 262 and 264 are spread across a width of the shoe-fit testing device 200 in a downward sloping curve S from pseudo bone element 260, positioned above an instep of the instep side 207 of the shoe-fit testing device 200, to pseudo bone element 264 positioned towards an outer edge 208 of the shoe-fit testing device 200. The rear surface 268 of the pseudo bone element 260 and the rearward dome-shaped nose 280 of the pseudo bone element 264 are positioned proximate the lower portion 232 of the ankle joint component 220 while the rearward dome-shaped nose 274 of pseudo bone element 262 is positioned more forwardly and further distant from the lower portion 232 of the ankle joint component 220.

The plurality of removable flex inserts 224, including removable flex inserts 224*a*-224*d*, help to complete the approximation of the human metatarsal bones, as each terminates with a forward-extending, downward slope 284*a*-284*d* to forward vertical edge 286*a*-286*d*; the forward vertical edge 286*a*-286*d* approximate the location where the phalanges join the metatarsals in the human foot. It should be noted that, while four removable flex inserts 224 are illustrated, a greater or lesser number of removable flex inserts 224 can be used. For example, FIG. 2B illustrates the use of three removable flex inserts 224 leaving behind three open channels 227. Further, in certain examples, one or more of the removable flex inserts 224 are maintained within the final configuration of the shoe-fit testing device 200 while others of the removable flex inserts are removed from the shoe-fit testing device 200.

Each of removable flex inserts 224*a*, 224*c* and 224*d* comprises a straight elongate panel of solid material that extends from the forward vertical edge 286*a*, 286*c*, 286*d* to a rearward vertical edge 288*a*, 288*c*, 288*d*. Removable flex insert 224*b* also comprises an elongate panel of material that extends rearward from its front vertical edge 286*b* rearward including a jog 287 in the removable flex insert 224*b* enabling a portion 225 of the removable flex insert 224*b* to align and extend through channel 258, of the lower portion 232 of the ankle joint component 220, to its rearward vertical edge 286*b*; the portion 225 of the removable flex insert 224*b* is generally centered under the ankle joint component 220 and is vertically aligned with the channel 258, the central projection 254 and the channel 242 of the lower and upper portions 232, 230 of the ankle joint component 220. Removable flex insert 224*b* helps to stabilize the foot of the shoe-fit testing device 200 relative to the ankle portion 201 of the shoe-fit testing device 200 during the molding process (described further below). Once the molding process is complete, the removable flex inserts 224 are removed from the molded shoe-fit testing device 200. Removal of the removable flex inserts 224 leaves the molded shoe-fit testing device 200 with corresponding open flex channels 227 (see FIG. 2B) in the shapes of the respective removable flex inserts 224; the open flex channels 227 being an element of the pseudo soft tissue structure 212. The open flex channels 227 enable the shoe-fit testing model 200 to flex, e.g. be compressed and uncompressed, similar to a human foot when inserted and withdrawn from a shoe. In certain examples, such as in fabricating a child size shoe-fit testing device 200, it may possible to eliminate use of the flex inserts 224 during the molding process with the molded material itself providing a sufficient amount of flex in the fabricated shoe-fit testing device 200 to approximate the flex of a child's foot.

The toe plate 226 approximates the rigidity of the small toes and is in the form of an arcuate plate that is positioned horizontal relative to the front vertical edges 286*a*-286*d* of the removable flex inserts 224*a*-224*d*; the toe plate 226 is positioned at approximately the mid-vertical height of the vertical front edges 286*a*-286*d* of the removable flex inserts 224*a*-224*d*. The toe plate 226 includes an upper surface 290 and a lower surface 292 connected by sides 294*a*-294*d*.

The first hallux stabilizer 228 approximates the stability of the large toe (i.e., the first hallux) of the foot. The first hallux stabilizer 228 generally comprises a cylindrical body 295 with a dome-shaped forward end 296 and a dome-shaped rearward end 297.

Referring once again to FIGS. 2A-2B, the pseudo soft structure tissue 212 structure generally includes an ankle and lower leg portion 201, a heel portion 202, an upper foot portion 203, a foot bottom 204, a plurality of small toes 205 and a large toe 206, as well as an instep edge 207 and an outer edge 208. A length, instep girth and joint girth of the shoe-fit testing device 200 can be measured on the shoe-fit testing device 200 consistent with those of FIGS. 1A-1B. Prior to molding and curing, the material of the pseudo soft tissue structure 212 is a flowable material that is capable of filling all of the interstices that exist between the plurality of elements that make up the pseudo skeletal structure 210. In certain examples, the material of the pseudo soft tissue structure 212 comprises a medium viscosity, high tear strength silicone (e.g., Shore A Hardness (±5) of 15; Tear Resistance (ASTM D624) of 55 pli; Tensile Strength (ASTM D412) of 455 psi; Density (ASTM D792) of 0.997 g/cc). However, other suitable, molding materials or combination of materials, can also be used.

Figure 7:
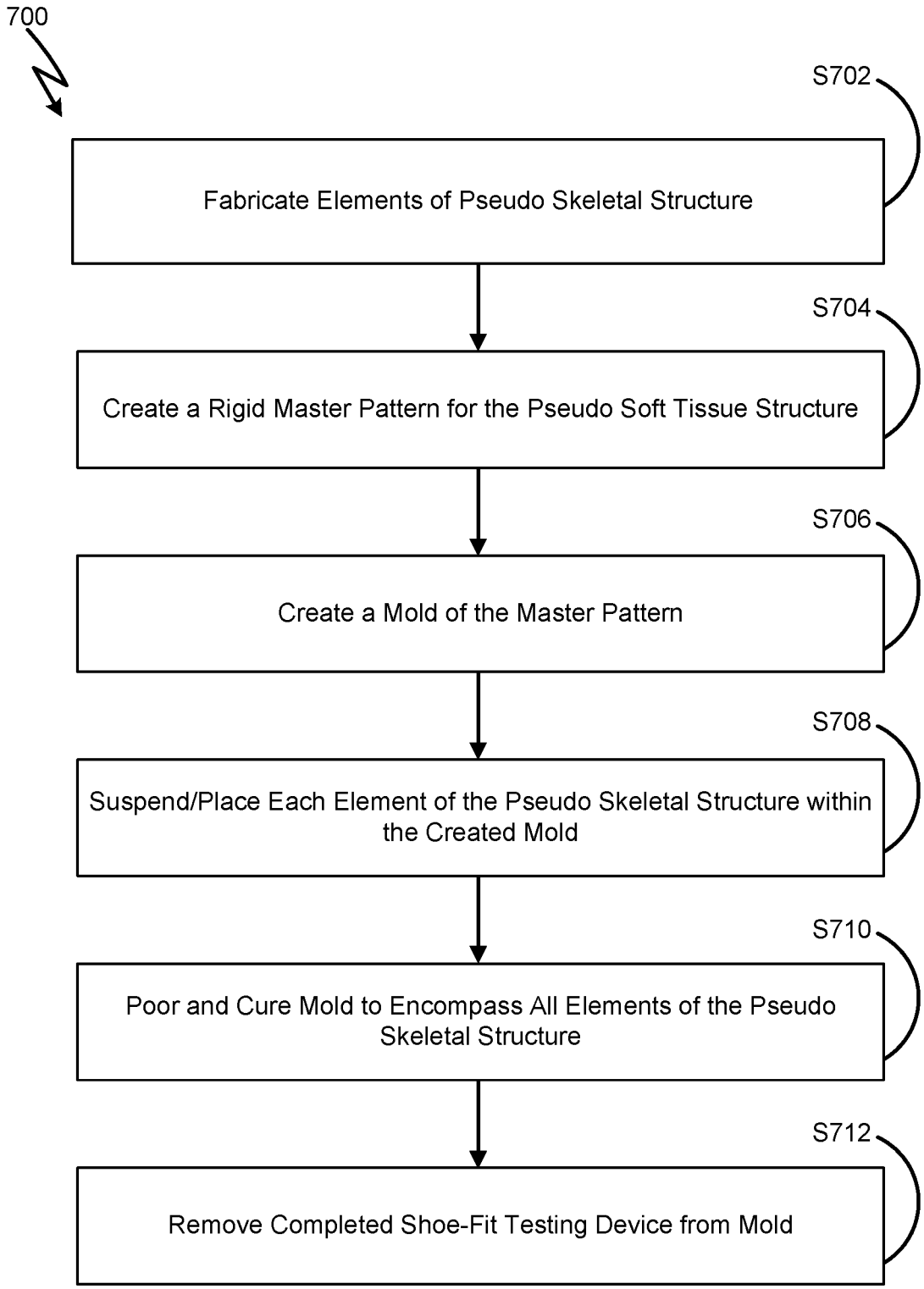
FIG. 7 is a flowchart illustrating a process for fabricating a shoe-fit testing device.

The flow chart of FIG. 7 illustrates an example process 700 for fabricating the shoe-fit testing device 200. It will be appreciated that additional or fewer process steps can be used to obtain the resultant product of the shoe-fit testing device 200 without departing from the spirit or scope of the invention; the sequence of steps can also be altered without departing from the spirit or scope of the invention. Further, different materials or combinations of materials, as known to those skilled in the art, can be used to obtains the resultant product of the shoe-fit testing device 200 without departing from the spirit or the scope of the invention.

The fabrication process 700 begins with fabricating the various elements of the pseudo skeletal structure 210 (S702) including the ankle joint component 220, the pseudo metatarsal component 222, the plurality of removable flex inserts 224 including removable flex inserts 224*a*-224*d*, the toe plate 226 and the first hallux stabilizer 228. The elements of the pseudo skeletal structure 210 can be manufactured via any appropriate means including but not limited to: three-dimensional printing, molding, thermoforming, and/or vacuum casting.

The fabrication 700 process continues by creating a rigid master pattern (S704) for the outer surfaces of the pseudo soft tissue structure 212, which approximates the outer skin surface of the soft tissue structure of the human foot and ankle. In certain examples, the rigid master pattern is of an ABS plastic or other suitable rigid material. As indicated above, the master pattern is generated based on design parameters that reflect a composite of the measurements taken from hundreds or more of live models for a specific shoe size, e.g. US size 6. The master pattern can be manufactured via an appropriate means including but not limited to: three-dimensional printing, molding, thermoforming, and/or vacuum casting.

After the master pattern has been fabricated, a mold is poured and cured (S706) about the master pattern. After curing, the mold is cut into at least two interfacing pieces allowing removal of the master pattern and access to the mold itself. In certain examples, the material of the mold comprises a silicone or other appropriate mold material (or combination of materials). In certain examples, the silicone mold has a Shore A Hardness (±4) of 42, a Tear Resistance (ASTM D624) of 120±20 ppi and a Tensile Strength (ASTM D412) of 600±50 psi.

Figure 8:
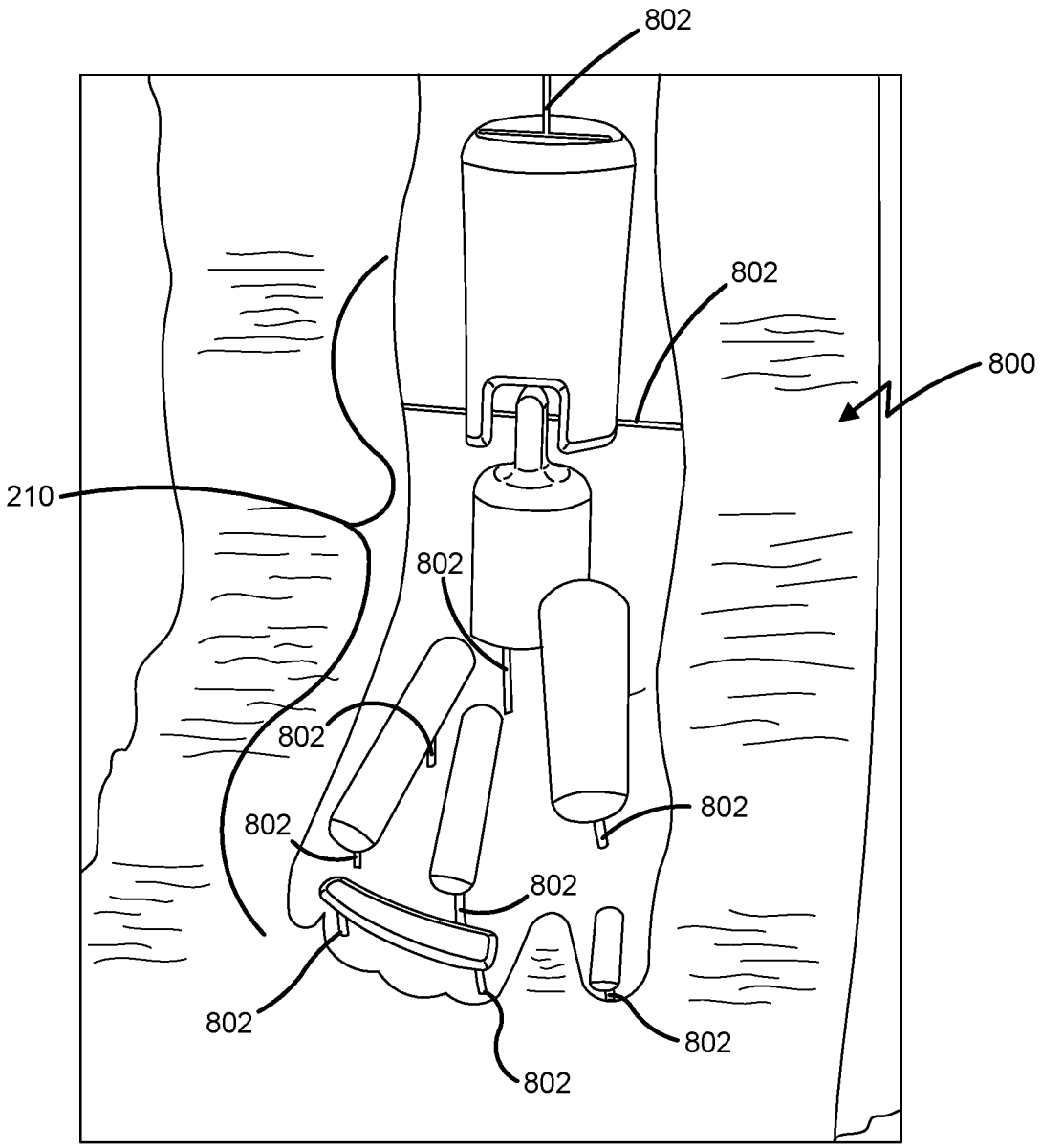
FIG. 8 illustrates the pseudo skeletal structure of FIG. 3, excepting the removable flex inserts, within a shoe-fit testing device mold.

The pseudo skeletal structure 210 is then suspended, or otherwise placed, within the mold (S708) with each element of the pseudo skeletal structure 210 being placed independently of the others through use of small diameter placement rods that are secured to each of the elements. Note that none of the elements of the pseudo skeletal structure 210 is in contact with another element of the pseudo skeletal structure 210. See FIG. 8 for an illustration of the pseudo skeletal structure 210 positioned within the mold 800 with various rods 802; flex inserts 224, not shown, are set upon a bottom surface of the mold and do not require suspension.

Once all elements of the pseudo skeletal structure 212 are in place within the mold and the mold has been sealed, while allowing for appropriate venting, a urethane, or other suitable materials or combination of materials, is injected into the mold (S710). In certain examples, the urethane is a two-part urethane. In certain examples, the urethane is a polyurethane elastomer having a Shore A Hardness (D2240) of 15±5, a Tear Strength (ASTM D624) of 55 pli, and a Tensile Strength (ASTM D412) of 455.

Finally, when the urethane is cured, the mold is re-opened and a completed shoe-fit testing device 200 can be removed from the mold (S712) whereby any gates and vents are cleaned from the shoe-fit testing device 200. Further, any molding material covering the flex inserts 224 is removed along with the flex inserts 224 themselves to leave behind the open flex channels 227 (see FIG. 2B) that enable the shoe-fit testing device 200 to flex, e.g. compress and uncompress, in the areas of the instep girth and the joint girth. The pseudo skeletal elements remaining in the shoe-fit testing device 200, e.g. all except the removable flex inserts 224, help provide rigidity, stability, yet some flexibility in the upper foot, heel and ankle portions of the shoe-fit testing device. For example, the shoe-fit testing device 200 can twist at the ankle and the upper foot portion, e.g. the area containing the pseudo metatarsal component 222, can flex, e.g. be compressed and uncompressed, such as when inserted into a shoe. Shoe-fit testing models can be made for one or both of the left and right foot.

The finished shoe-fit testing device 200, which is fabricated to a specific size, is suitable to test a shoe of a corresponding size. Specifically, the shoe-fit testing device 200 can be inserted into a shoe wherein the ability to insert and withdraw the shoe-fit testing device 200 can be observed and/or measured, and pressure points, if any, of the shoe upon the shoe-fit testing device 200 can be assessed knowing that the flexure of shoe-fit testing device 200 approximates that of the human foot without requiring the presence of a live foot model. Specifically, the shoe-fit testing device 200 has the ability to contract at least at its instep girth and/or its joint girth when squeezed to be inserted into a shoe. In certain examples, any of the various measurements described herein, e.g. joint and instep girth, are taken of the shoe itself with the shoe-fit testing device inserted within the shoe. In certain examples, measurements and/or observations for adequate toe room, tightness, heel slip, and the ease with which to insert and/or remove the shoe-fit testing device 200 can be performed.

Figure 9:
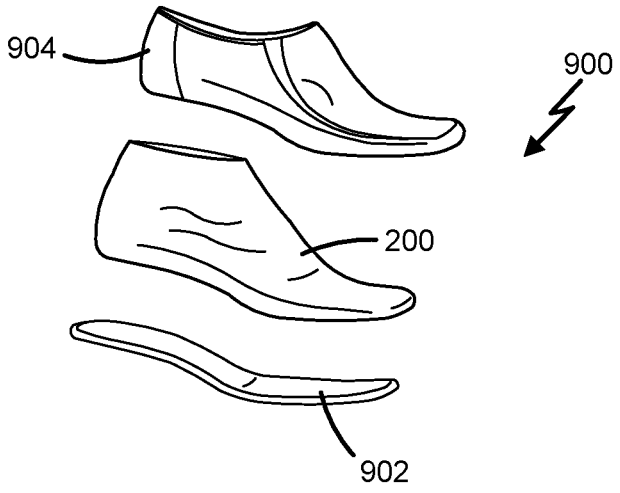
FIG. 9 illustrates a shoe manufactured in accordance with the shoe fit testing device.

FIG. 9 illustrates a simplified shoe 900 comprising at least a sole 902 and an upper 904 that has been manufactured in conformance with the shoe-fit testing device 200. Of course the shoe 900 may comprise any number of additional, or alternative, elements that are known in the art of making shoes, e.g., heel, footbed, lining, laces, eyelets, straps, toe cap, etc. In the manufacturing of the shoe 900, the shoe-fit testing device 200 may, itself, function as the last to which the components of the shoe are fitted while in other examples the shoe-fit testing device 200 functions as the model from which the last is made.

Figure 10:
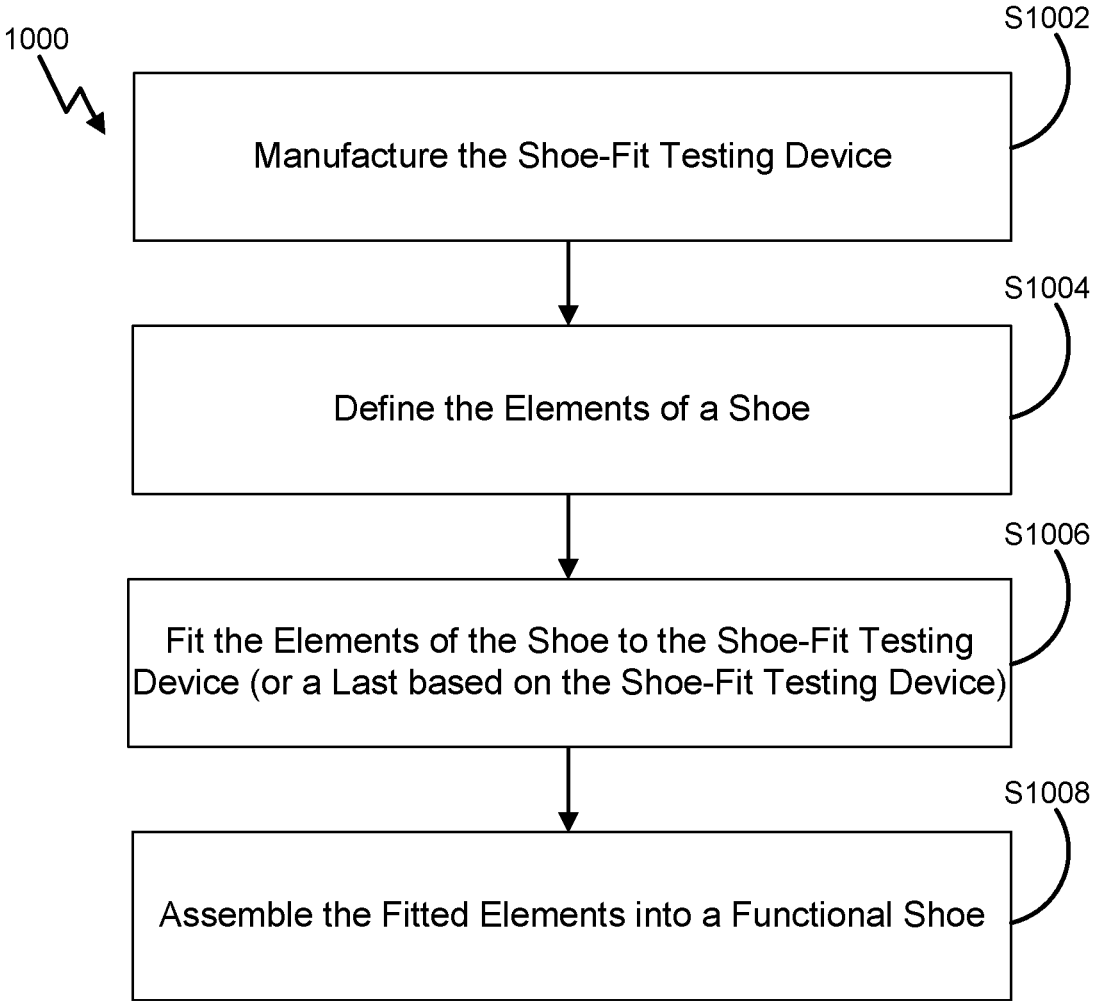
FIG. 10 is a flowchart illustrating a process for manufacturing a shoe.

FIG. 10 outlines the process 1000 for making a shoe utilizing the shoe-fit testing device 200. The process 1000, the steps of which can be performed in any appropriate order, includes manufacturing the shoe-fit testing device 200 as described herein, S1002; defining the elements of the shoe (e.g., a sole and an upper, etc.), S1004; fitting the elements of the shoe to the shoe-fit testing device (or a last based on the shoe-fit testing device), S1006; and assembling the fitted elements into a functional shoe, S1008.

The description and illustration of one or more examples provided in this application are not intended to limit or restrict the scope as claimed in any way. The aspects, examples, and details provided in this application are considered sufficient to convey possession and enable others to make and use the best mode. Implementations should not be construed as being limited to any aspect, example, or detail provided in this application. Regardless of whether shown and described in combination or separately, the various features (both structural and methodological) are intended to be selectively included or omitted to produce an example with a particular set of features. Having been provided with the description and illustration of the present application, one skilled in the art may envision variations, modifications, and alternate examples falling within the spirit of the broader aspects of the general inventive concept embodied in this application that do not depart from the broader scope.

What is claimed:

1. A shoe-fit testing device:

a foot and ankle pseudo skeletal structure including a plurality of pseudo skeletal elements; and a pseudo soft tissue structure encompassing the foot and ankle pseudo skeletal structure and separating the plurality of pseudo skeletal elements from one another, the shoe-fit testing device capable of transitioning between an uncompressed state and a compressed state, wherein in the uncompressed state a joint girth of the shoe-fit testing device has a first value and wherein in the compressed state the joint girth of the shoe-fit testing device has a second value that is less than the first value.

2. The shoe-fit testing device of claim 1, wherein the plurality of pseudo skeletal elements comprise a number of elements that is less than a number of bones that exist in the human ankle and foot.

3. The shoe-fit testing device of claim 1, wherein the plurality of pseudo skeletal elements approximate the five metatarsal bones of the human foot with less than five of the plurality of pseudo skeletal elements.

4. The shoe-fit testing device of claim 3, wherein exactly three of the plurality of pseudo skeletal elements approximate the five metatarsal bones of the human foot.

5. The shoe-fit testing device of claim 1, wherein at least a portion of the plurality of pseudo skeletal elements include a hollow center portion.

6. The shoe-fit testing device of claim 1, wherein the second value is at least five percent less than the first value.

7. The shoe-fit testing device of claim 1, wherein in the uncompressed state an instep of girth of the shoe-fit testing device has a first value and when in the compressed state the instep girth of the shoe-fit testing device has a second value less than the first value.

8. A shoe-fit testing device comprising:

a foot and ankle pseudo skeletal structure including a plurality of pseudo skeletal elements at least a portion of which form a pseudo ankle joint and a pseudo metatarsal; and a pseudo soft tissue structure encompassing the foot and ankle pseudo skeletal structure and separating at least a portion of the plurality of pseudo skeletal elements from one another, the pseudo soft tissue structure including a plurality of open flex channels.

9. The shoe-fit testing device of claim 8, wherein the plurality of pseudo skeletal elements include a toe plate and a first hallux stabilizer.

10. The shoe-fit testing device of claim 8, wherein the pseudo ankle joint includes an upper portion that defines an elongate channel and a lower portion that defines a projection that is received in the elongate channel.

11. The shoe-fit testing device of claim 10, wherein the elongate channel of the upper portion of the pseudo ankle joint and the projection of the lower portion of the pseudo ankle joint are separated from one another by the pseudo soft tissue structure.

12. The shoe-fit testing device of claim 8, wherein the pseudo metatarsal includes less than five pseudo skeletal elements to approximate the five metatarsal bones of the human foot.

13. The shoe-fit testing device of claim 8, wherein at least one of the plurality of open flex channels includes a portion that is centered beneath the pseudo ankle joint component.

14. The shoe-fit testing device of claim 8, wherein the shoe-fit testing device transitions between an uncompressed state and a compressed state, wherein in the uncompressed state a joint girth of the shoe-fit testing device has a first value and wherein in the compressed state the joint girth of the shoe-fit testing device has a second value that is less than the first value.

15. The shoe-fit testing device of claim 14, wherein the second value is at least five percent less than the first value.

16. The shoe-fit testing device of claim 8, wherein at least a portion of the plurality of pseudo skeletal elements are fabricated from an acrylonitrile butadiene styrene (ABS) plastic material.

17. The shoe-fit testing device of claim 16, wherein the pseudo soft tissue structure is of a urethane elastomer material.

18. A method of manufacturing a shoe-fit testing device, comprising:

fabricating a plurality of structural components that approximate a skeletal structure of a human foot and ankle;

fabricating a mold that approximates the outer skin surface of the soft tissues of the human foot and ankle;

placing the plurality of structural components within the mold such that each of the plurality of structural components is maintained distinctly separate from all other structural components, the placing of the plurality of structural components including suspending at least a portion of the plurality of structural components within the mold;

injecting the mold with a molding material, the molding material encompassing the plurality of structural components and forming a shoe-fit testing device; and removing the shoe-fit testing device from the mold.

19. A method of manufacturing a shoe, comprising:

manufacturing a shoe-fit testing device according to the method of claim 18, defining the elements of a shoe, including a sole and an upper;

fitting the sole and the upper to the shoe-fit testing device or a last based on the shoe fit testing device; and assembling the fitted elements as a shoe.

20. A shoe, wherein the shoe is manufactured according to the method of claim 19.

* * * * *